US008757563B2

(12) United States Patent
Muse

(10) Patent No.: US 8,757,563 B2
(45) Date of Patent: Jun. 24, 2014

(54) FUNNEL AND STAND FOR BAG

(75) Inventor: John Richard Muse, Douglasville, GA (US)

(73) Assignee: Pratt Industries, Inc., Conyers, GA (US)

( * ) Notice: Subject to any disclaimer, the term of this patent is extended or adjusted under 35 U.S.C. 154(b) by 44 days.

(21) Appl. No.: 13/164,473

(22) Filed: Jun. 20, 2011

(65) Prior Publication Data

US 2011/0309209 A1 Dec. 22, 2011

Related U.S. Application Data

(60) Provisional application No. 61/357,516, filed on Jun. 22, 2010.

(51) Int. Cl.
*B65B 55/04* (2006.01)

(52) U.S. Cl.
USPC ..... 248/97; 248/99

(58) Field of Classification Search
USPC ..... 248/97, 99, 152, 150; 15/257.1, 257.3, 15/257.9; 141/108, 337, 390, 391
See application file for complete search history.

(56) References Cited

U.S. PATENT DOCUMENTS 361,185 A 5/1887 Richards
513,352 A 1/1894 Vogt
567,464 A 9/1896 Fulton
593,721 A 11/1897 Hoffman
645,544 A 3/1900 Bissell
672,657 A * 4/1901 Vautrot ..... 222/566
1,088,633 A 2/1914 Simmons
1,234,057 A * 7/1917 McIntyre ..... 141/314
1,571,608 A 2/1926 Stillman
1,858,793 A 5/1932 Archibald
1,879,410 A * 9/1932 Morris et al. ..... 493/480
1,879,950 A * 9/1932 Read, Jr. ..... 217/3 FC
2,430,155 A * 11/1947 Buttery ..... 141/390
2,550,959 A 5/1951 Bowman
2,939,614 A * 6/1960 Hill ..... 222/190
3,257,068 A 6/1966 Wright
3,324,906 A 6/1967 Chu
3,734,340 A * 5/1973 Ippolito et al. ..... 141/391
3,746,240 A 7/1973 Flynn (Continued)

OTHER PUBLICATIONS

Muse; U.S. Patent Application Entitled: Bag Stand under U.S. Appl. No. 13/164,464, filed Jun. 20, 2011; 19 pgs.
Muse; U.S. Patent Application Entitled: Bag Support under U.S. Appl. No. 13/164,481, filed Jun. 20, 2011; 21 pgs.
Muse; U.S. Patent Application Entitled: Bag Stand under U.S. Appl. No. 13/551,575, filed Jul. 17, 2012, 19 pgs.

(Continued)

*Primary Examiner* — Kimberly Wood
(74) *Attorney, Agent, or Firm* — Taylor English Duma LLP

(57) ABSTRACT

Disclosed is a bag stand including a hollow stand having an inner surface, an outer surface, a top end, and a bottom end, the hollow stand including at least one side panel, each side panel having two ends, each end of each side panel connected to an adjacent end of a side panel to form a substantially continuous outer surface and a substantially continuous inner surface thereby defining an opening along the top end of the hollow stand; and a funnel interfacing with the top end of the hollow stand and having an inner surface, an outer surface, a top end, a bottom end, and at least two side ends, the funnel defining an opening at each of the top end and the bottom end of the funnel, the top end of the funnel having a larger opening and the bottom end of the funnel having a smaller opening.

9 Claims, 10 Drawing Sheets

(56) References Cited

U.S. PATENT DOCUMENTS

| | | | | |
|---|---|---|---|---|
| 3,891,136 | A * | 6/1975 | Woeste | 229/115 |
| 3,938,731 | A | 2/1976 | Ross et al. | |
| 3,977,594 | A | 8/1976 | Swan | |
| 3,983,914 | A * | 10/1976 | Benson | 141/390 |
| 4,037,778 | A | 7/1977 | Boyle | |
| 4,115,909 | A | 9/1978 | Corella | |
| 4,139,029 | A * | 2/1979 | Geraci | 141/98 |
| 4,258,842 | A * | 3/1981 | Falkstein | 206/8 |
| 4,268,081 | A * | 5/1981 | Hawkinson | 248/99 |
| 4,273,167 | A | 6/1981 | Stillwell | |
| 474,382 | A | 5/1982 | Haines | |
| 4,338,979 | A * | 7/1982 | Dow | 141/10 |
| 4,361,267 | A | 11/1982 | Wozniacki | |
| 4,366,916 | A * | 1/1983 | Guido et al. | 229/103 |
| 4,457,483 | A * | 7/1984 | Gagne | 248/97 |
| 4,530,533 | A | 7/1985 | Dieter | |
| 4,643,380 | A | 2/1987 | Copeland | |
| 4,659,045 | A * | 4/1987 | Flynn | 248/99 |
| 4,669,689 | A * | 6/1987 | Jones | 248/99 |
| 4,697,771 | A | 10/1987 | Majors | |
| 4,749,011 | A * | 6/1988 | Rylander | 141/316 |
| 4,760,982 | A * | 8/1988 | Cooke | 248/99 |
| 4,884,603 | A | 12/1989 | Simpson | |
| 4,890,652 | A | 1/1990 | Hoerner | |
| 4,940,200 | A | 7/1990 | Sawyer | |
| 4,955,496 | A * | 9/1990 | Nelson | 141/390 |
| 4,979,547 | A | 12/1990 | Hoerner | |
| 5,018,637 | A * | 5/1991 | Miller | 229/117.35 |
| 5,054,724 | A * | 10/1991 | Hutcheson | 248/97 |
| 5,056,679 | A * | 10/1991 | Lonczak | 141/390 |
| 5,065,965 | A * | 11/1991 | Aulabaugh | 248/99 |
| 5,080,308 | A * | 1/1992 | Franks | 248/99 |
| 5,090,756 | A | 2/1992 | Pfisterer | |
| 5,129,609 | A | 7/1992 | Tobin | |
| 5,271,589 | A | 12/1993 | Belous | |
| 5,285,988 | A | 2/1994 | Bogren | |
| 5,292,093 | A | 3/1994 | Shumake | |
| 5,316,060 | A | 5/1994 | Hodgdon et al. | |
| 5,372,269 | A * | 12/1994 | Sutton et al. | 220/62 |
| 5,400,989 | A * | 3/1995 | Gaskill | 248/97 |
| D361,185 | S * | 8/1995 | Seiler et al. | D34/5 |
| 5,593,117 | A | 1/1997 | Alexander | |
| 5,601,230 | A | 2/1997 | Bell | |
| 5,716,033 | A * | 2/1998 | Gibson | 248/95 |
| 5,765,614 | A | 6/1998 | Kardosh | |
| 5,816,431 | A | 10/1998 | Giannopoulos | |
| 5,868,364 | A | 2/1999 | MacMillan | |
| 5,871,037 | A | 2/1999 | Feldt | |
| 5,897,084 | A | 4/1999 | Judge | |
| 5,915,768 | A | 6/1999 | Young | |
| 5,918,651 | A | 7/1999 | Gazdy et al. | |
| 5,979,842 | A | 11/1999 | Fan | |
| 6,007,030 | A | 12/1999 | Judge | |
| 6,035,908 | A * | 3/2000 | Hoffmann | 141/331 |
| 6,085,647 | A | 7/2000 | Burow | |
| 6,116,548 | A | 9/2000 | Oleson | |
| 6,116,549 | A | 9/2000 | Santa Cruz et al. | |
| 6,131,759 | A | 10/2000 | Young | |
| 6,135,518 | A | 10/2000 | Holthaus | |
| 6,189,841 | B1 * | 2/2001 | LaPoint et al. | 248/99 |
| 6,202,718 | B1 * | 3/2001 | Innocenti | 141/391 |
| 6,273,156 | B1 | 8/2001 | Carillo | |
| 6,296,212 | B1 | 10/2001 | Monahan | |
| 6,340,037 | B1 | 1/2002 | Stafford | |
| 6,367,747 | B1 | 4/2002 | Mulle | |
| 6,415,713 | B1 | 7/2002 | Abrams | |
| 6,450,461 | B1 * | 9/2002 | Lohmann | 248/99 |
| 6,536,488 | B1 | 3/2003 | Pchobradsky | |
| 6,554,810 | B1 * | 4/2003 | Wilk et al. | 604/323 |
| 6,659,407 | B2 | 12/2003 | Asaro | |
| 6,708,742 | B2 * | 3/2004 | Weathers et al. | 141/391 |
| D500,457 | S * | 1/2005 | Peeples et al. | D11/152 |
| D502,582 | S | 3/2005 | Boles | |
| 6,860,094 | B1 | 3/2005 | Abrams | |
| 6,866,070 | B2 | 3/2005 | King | |
| D513,352 | S | 12/2005 | Weathers et al. | |
| 6,983,965 | B1 * | 1/2006 | Bergell | 294/214 |
| 7,066,220 | B1 | 6/2006 | Take et al. | |
| 7,066,379 | B2 * | 6/2006 | McLeod et al. | 229/120.26 |
| 7,152,894 | B2 * | 12/2006 | Weathers et al. | 100/295 |
| 7,246,641 | B2 | 7/2007 | Blessman | |
| 7,302,978 | B1 | 12/2007 | Kolarik | |
| D567,464 | S * | 4/2008 | Dullum | D34/6 |
| 7,367,600 | B1 * | 5/2008 | Lew et al. | 294/214 |
| 7,398,913 | B2 * | 7/2008 | McClure | 229/117.35 |
| 7,407,139 | B1 * | 8/2008 | Dolan | 248/99 |
| 7,494,096 | B2 | 2/2009 | Paloian et al. | |
| D593,721 | S * | 6/2009 | Koll | D34/5 |
| 7,651,024 | B2 | 1/2010 | Barner | |
| 7,694,838 | B2 | 4/2010 | Yang | |
| 7,712,623 | B2 * | 5/2010 | Wentz et al. | 220/495.04 |
| 7,736,057 | B2 | 6/2010 | VanBost | |
| 7,810,766 | B2 | 10/2010 | Blessman | |
| 7,815,153 | B2 | 10/2010 | Campbell et al. | |
| D633,268 | S * | 2/2011 | Bottita | D34/6 |
| D639,519 | S * | 6/2011 | Gomez | D34/6 |
| 2002/0074247 | A1 | 6/2002 | Tremblay | |
| 2003/0173471 | A1 | 9/2003 | Weathers et al. | |
| 2003/0218104 | A1 | 11/2003 | Klotz | |
| 2006/0011785 | A1 | 1/2006 | McLean | |
| 2006/0144467 | A1 | 7/2006 | Butzer | |
| 2008/0128479 | A1 * | 6/2008 | Bates et al. | 229/117.16 |
| 2010/0108826 | A1 | 5/2010 | Fernandez et al. | |
| 2010/0142860 | A1 | 6/2010 | Mincozzi | |
| 2010/0237202 | A1 | 9/2010 | Mincozzi | |
| 2010/0243650 | A1 | 9/2010 | Manley | |
| 2010/0276247 | A1 | 11/2010 | Babineau et al. | |

OTHER PUBLICATIONS

Muse; U.S. Patent Application Entitled: Funnel and Stand for Bag under U.S. Appl. No. 13/551,583, filed Jul. 17, 2012, 16 pgs.

Muse; U.S. Provisional Application entitled: Lawn Refuse Bag Holder having U.S. Appl. No. 61/357,526, filed Jun. 22, 2010; 10 pgs.

Muse; U.S. Provisional Application Entitled: Insert for Gathering Lawn Refuse into a Bag having U.S. Appl. No. 61/357,518, filed Jun. 22, 2010, 15 pgs.

Muse; U.S. Provisional Application Entitled: Bag Stand having U.S. Appl. No. 61/508,914, filed Jul. 18, 2011, 16 pgs.

Muse; U.S. Provisional Application Entitled: Funnel and Stand for Bag having U.S. Appl. No. 61/508,934, filed Jul. 18, 2011, 12 pgs.

Muse, John Richard; Restriction Requirement for U.S. Appl. No. 13/164,464, filed Jun. 20, 2011, mailed Oct. 19, 2012; 6 pgs.

Muse, John Richard; Non-Final Office Action for U.S. Appl. No. 13/164,481, filed Jun. 20, 2011, mailed Dec. 5, 2012; 18 pgs.

Muse, John Richard; Non-Final Office Action for U.S. Appl. No. 13/164,464, filed Jun. 20, 2011; mailed Nov. 16, 2012, 17 pgs.

Muse; Non-Final Office Action for U.S. Appl. No. 13/164,481, filed Jun. 20, 2011, mailed Jul. 11, 2013, 11 pgs.

Muse, John Richard; Final Office Action for U.S. Appl. No. 13/164,464, filed Jun. 20, 2011; mailed Feb. 22, 2013, 6 pgs.

Muse, John Richard; Final Office Action for U.S. Appl. No. 13/164,481, filed Jun. 20, 2011, mailed Apr. 5, 2013, 17 pgs.

Muse, John Richard; Non-Final Office Action for U.S. Appl. No. 13/164,464, filed Jun. 20, 2011, mailed May 29, 2013, 12 pgs.

Muse, John Richard; Final Office Action for U.S. Appl. No. 13/164,464, filed Jun. 20, 2011, mailed Sep. 23, 2013, 8 pgs.

Muse, John Richard; Notice of Allowance for U.S. Appl. No. 13/164,481, filed Jun. 20, 2011, mailed Oct. 23, 2013, 11 pgs.

Muse, John Richard; Non-Final Office Action for U.S. Appl. No. 13/551,575, filed Jul. 17, 2012, mailed Dec. 6, 2013, 45 pgs.

Muse, John Richard; Final Office Action for U.S. Appl. No. 13/164,464, filed Jun. 20, 2011, mailed Jan. 10, 2014, 8 pgs.

Muse, John Richard; Applicant Initiated Interview Summary for serial No. 13/164,464, filed Jun. 20, 2011, mailed Mar. 11, 2014, 5 pgs.

Muse, John Richard; Notice of Allowance for serial No. 13/164,464, filed Jun. 20, 2011, mailed Apr. 29, 2014, 11 pgs.

* cited by examiner

FUNNEL AND STAND FOR BAG

CROSS-REFERENCE TO RELATED APPLICATIONS

This application claims the benefit of U.S. Provisional Application 61/357,516 filed on Jun. 22, 2010, which is hereby incorporated herein in its entirety by reference.

FIELD

The disclosure relates to refuse. More particularly, the disclosure relates to bagging refuse and filling refuse bags.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Disclosed is a bag stand used primarily for holding and filling refuse bags. The bag stand includes a hollow stand and a funnel It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while alternative embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

Figure 1:
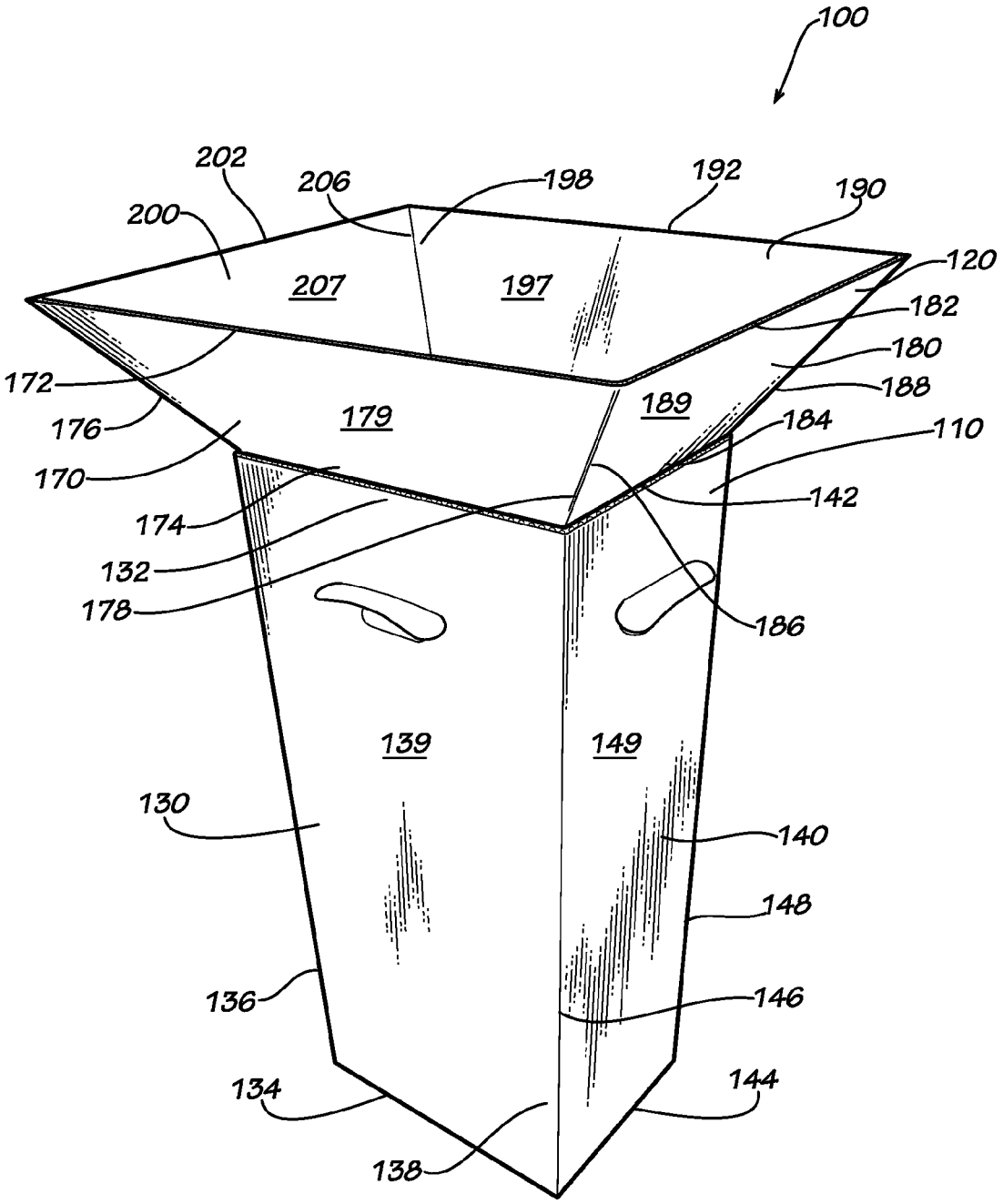
FIG. 1 is a perspective view of one embodiment of an assembled bag stand according to the present disclosure.

FIG. 1 shows one embodiment of the disclosed bag stand 100. A bag stand 100 includes a hollow stand 110 and a funnel 120. Both the hollow stand 110 and the funnel 120 have rectangular cross-sections in the current embodiment, although other cross-sectional profiles are included in this disclosure.

The hollow stand 110 in the current embodiment includes four side panels 130,140 (150,160 not shown). It should be noted that the hollow stand 110 may have any number of side panels, and the selection of four side panels for the current embodiment should not connote any preference for any number of panels or shape for each panel. In the current embodiment, each of the side panels 130,140,150,160 has a top end, a bottom end, a left end, and a right end. Side panel 130 includes a top end 132, a bottom end 134, a left end 136, and a right end 138. Side panel 140 includes a top end 142, a bottom end 144, a left end 146, and a right end 148. Side panel 150 (not shown in FIG. 1) includes a top end 152, a bottom end 154, a left end 156, and a right end 158. Side panel 160 (not shown in FIG. 1) includes a top end 162, a bottom end 164, a left end 166, and a right end 168. Each of the four side panels 130,140,150,160 is arranged so that its right end is connected to the left end of an adjacent side panel 140,150,160,130, thereby forming a continuous wall defining the hollow stand 110. Left end 146 is connected to right end 138, left end 156 is connected to right end 148, left end 166 is connected to right end 158, and left end 136 is connected to right end 168. All references to "left" and "right" in this disclosure refer to the left and right directions when viewed from the outside with the top end up and the bottom end down.

All connections to which this disclosure refers may be any connection sufficient to hold together the elements to be connected, including an integrated construction, glue, a notched end, or other types of connecting means.

Each side panel 130,140,150,160 has a flat outer surface 139,149,159,169, respectively, although the outer surface of each side panel 130,140,150,160 may be any shape in alternative embodiments. Although the side panels 130,140,150,160 are shown as all rectangular in shape and continuous, the side panels 130,140,150,160 may be of any shape and need not be continuous. For example, a small bar may fit within the definition of a side panel 130,140,150,160 if it replaces a side panel 130,140,150,160 in the current or another embodiment.

In the current embodiment, two sets of side panels exist to create a rectangular configuration. Side panels 140 and 160 are dimensioned so that their left ends 146,166 are a linear distance from their right ends 148,168, the linear distances being equal for each of the two side panels 140,160. Side panels 130 and 150 likewise are dimensioned so that their left ends 136,156 are a linear distance from their right ends 138, 158, the linear distances being equal for each of the two side panels 130,150. In the current embodiment, the linear distance between the left ends 136,156 and the right ends 138, 158 of the side panels 130,150, respectively, is greater than the linear distance between the left ends 146,166 and right ends 148,168 of side panels 140,160, respectively. The linear distances in the current embodiment are dimensioned to allow the hollow stand 110 to fit inside of a refuse bag 710 (seen in FIG. 7). Alternative embodiments may have different linear distances for other applications. Moreover, the linear distance between left ends 136,146,156,166 and right ends 138,148, 158,168 of each side panel 130,140,150,160, respectively, may be independent of the linear distance between the left end 136,146,156,166 and right end 138,148,158,168 of another side panel 130,140,150,160, and need not be the same as for any other side panel 130,140,150,160.

The funnel 120 includes four upper funnel panels 170,180, 190,200. Each upper funnel panel 170,180,190,200 has a top end 172,182,192,202, a bottom end 174,184 (194,204 not shown), a left end 176,186,196 (not shown),206, and a right end 178,188,198,208 (not shown), respectively. As with the hollow stand 110, each upper funnel panel 170,180,190,200 is oriented so that its right end is connected with the left end of an adjacent upper funnel panel 180,190,200,170. As such, left end 186 is connected to right end 178, left end 196 is connected to right end 188, left end 206 is connected to right end 198, and left end 176 is connected to right end 208. In some embodiments, complete attachment of all upper funnel panels 170,180,190,200 is not necessary as long as the funnel 120 is operational as a funnel Each upper funnel panel 170, 180,190,200 has an inner surface and an outer surface: upper funnel panel 170 has inner surface 177 (not shown) and outer surface 179, upper funnel panel 180 has inner surface 187 (not shown) and outer surface 189, upper funnel panel 190 has inner surface 197 and outer surface 199 (not shown), and upper funnel panel 200 has inner surface 207 and outer surface 209 (not shown).

Figure 2:
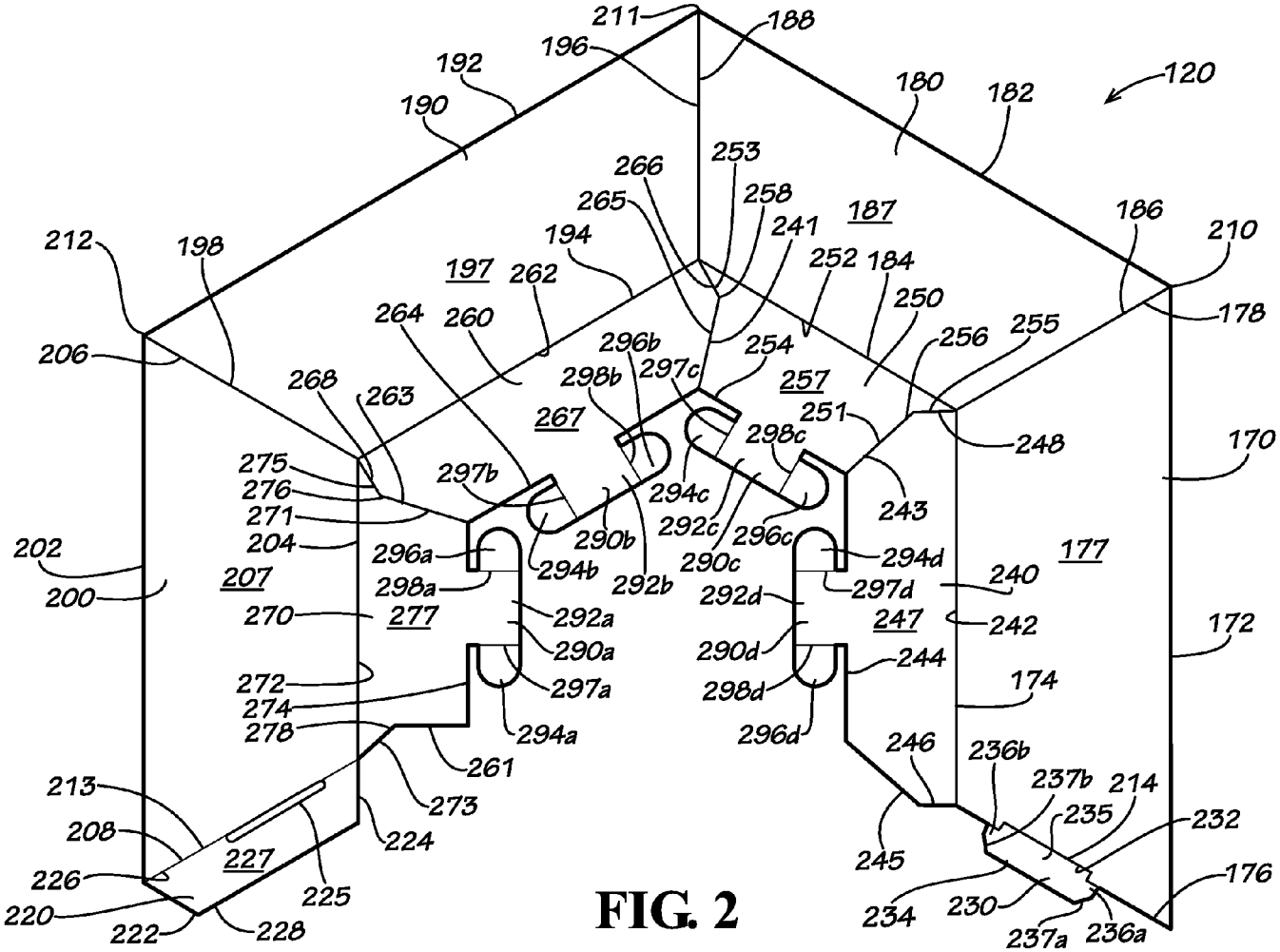
FIG. 2 is a schematic view of the inner surface of the funnel of the bag stand of FIG. 1.
Figure 4:
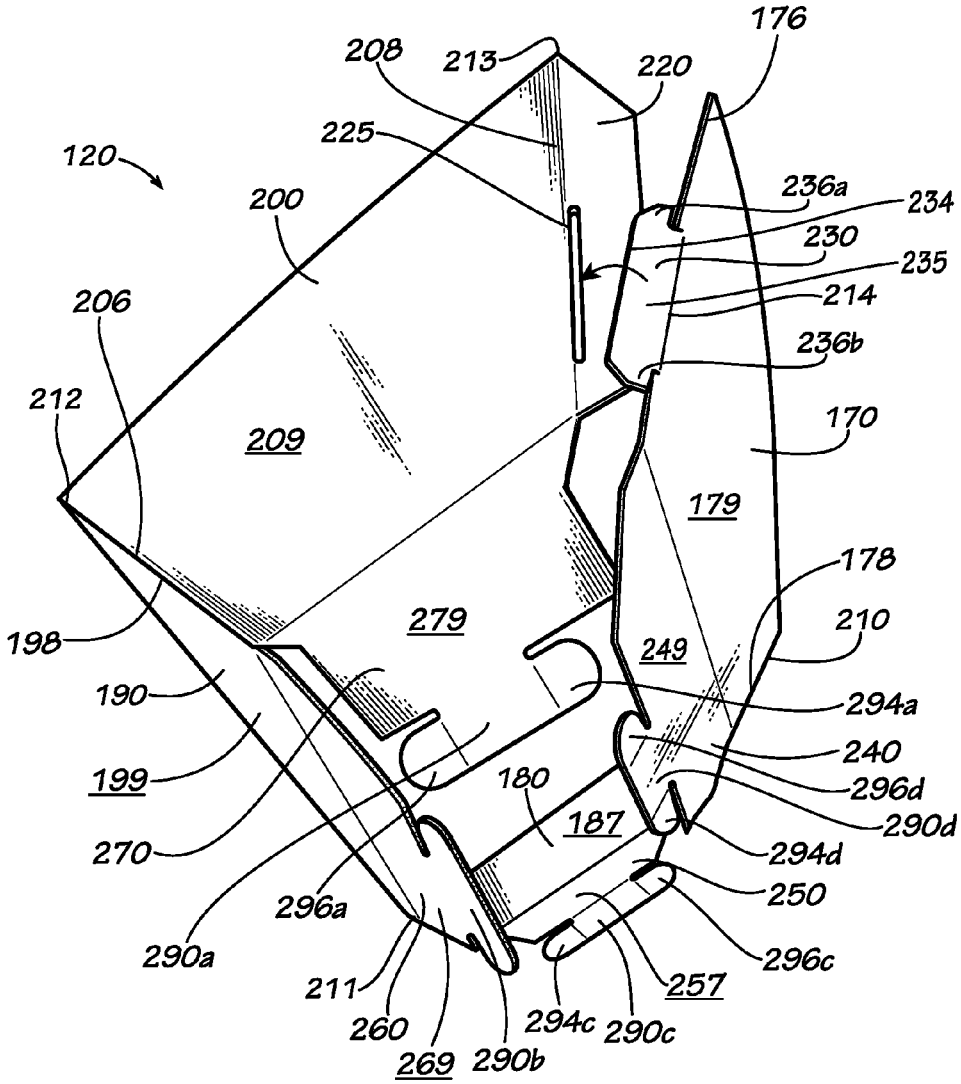
FIG. 4 is a perspective view of one embodiment of the funnel of the bag stand of FIG. 1 in assembly.

FIG. 2 shows a top view of a funnel blank of a funnel 120 from the inside. In the current embodiment, the funnel 120 is made of corrugated cardboard and is designed to be folded (as seen in FIG. 4) into a final funnel shape, as seen in perspective view in the assembly of FIG. 6. Because the funnel 120 is made of corrugated cardboard, it is designed to be formable into the final funnel shape of FIG. 6 from the funnel blank shown in the current view of FIG. 2.

Some of the connections between upper funnel panels 170, 180,190,200 are integrated. At such connections, a bend line is included to allow a user to bend the unattached funnel 120 into its final funnel shape of FIG. 4. As such, bend lines are located between the ends of integrated upper funnel panels: bend line 210 is located at the interaction of right end 178 and left end 186, bend line 211 is located at the interaction of right end 188 and left end 196, and bend line 212 is located at the interaction of right end 198 and left end 206. Bend lines to which this disclosure refers are designed as weakened regions, and may include a crease, a perforation, a series of perforations, or another arrangement to weaken the area of the bend line.

The interaction between upper funnel panel 170 and upper funnel panel 200 between left end 176 and right end 208 is not integrated in the current embodiment. Connected to upper funnel panel 200 is a connection tab 220. The connection tab 220 has a left end 226 and a right end 228. The connection tab 220 is connected by its left end 226 to the right end 208 of the upper funnel panel 200. The connection tab 220 has a slot 225 which is a cutout from the material. The connection tab 220 also has a top end 222 and a bottom end 224. The top end 222 extends at a downward angle from the top end 202 of the upper funnel panel 200. The bottom end 224 extends linearly at the same angle as the bottom end 204 of the upper funnel panel 200. The connection tab 220 has an inner surface 227 and an outer surface 229 (not shown). A bend line 213 is located at the connection of right end 208 and left end 226.

Connected to the left end 176 of the upper funnel panel 170 is an insertable tab 230. The insertable tab 230 has a connected end 232 and a terminating end 234. The connected end 232 is connected to the left end 176 of the upper funnel panel 170. The connection of the connected end 232 to the left end 176 is integrated in the current embodiment, having a bend line 214 which is a crease in the current embodiment. Other connections, including perforated or weakened regions, are contemplated as described previously in this disclosure. The insertable tab 230 is detached from the upper funnel panel 170 except along the connected end 232. The insertable tab 230 has a shank portion 235 and ear portions 236*a,b*. The ear portions 236*a,b* can be any shape, including circular, semicircular, and triangular, among others. In the current embodiment, the ear portions 236*a,b* each have a diagonal cutoff 237*a,b* so that each ear portion 236*a,b* is a right trapezoid shape.

Along the interior of the funnel blank are four lower funnel panels 240,250,260,270. Each lower funnel panel 240,250, 260,270 has an inner surface 247,257,267,277 and an outer surface 249,259,269,279, respectively (outer surfaces not shown). The lower funnel panels 240,250,260,270 each have an upper end 242,252,262,272, respectively. The lower funnel panels 240,250,260,270 are connected by their upper ends 242,252,262,272 to the bottom ends 174,184,194,204 of the upper funnel panels 170,180,190,200, respectively. In the current embodiment, the connections are integrated construction, although other connections are intended to be included in this disclosure. In the current embodiment, the lower funnel panels 240,250,260,270 are not connected to each other.

In some embodiments, lower funnel panels 240,250,260, 270 will not be included at all, as the upper funnel panels 170,180,190,200 may suffice for the intended purpose. In some embodiments, some of the lower funnel panels 240,250, 260,270 may be removed. In some embodiments, all features of the lower funnel panels or any portions or attachments may not be included if unnecessary for the specific embodiment.

As seen, not all of the lower funnel panels are the same. In the current embodiment, lower funnel panels 240 and 260 are about the same shape, but lower funnel panels 250 and 270 each include distinct features. Because the funnel 120 is made from one corrugated cardboard funnel blank, end portions of one lower funnel panel 240,250,260,270 correspond to end portions of adjacent lower funnel panels. For example, the end portions of lower funnel panel 250 correspond to end portions of lower funnel panel 260 and of lower funnel panel 240.

Lower funnel panel 240 includes the upper end 242, a bottom end 244, a left end 246, and a right end 248. Extending from about the middle of the left end 246 to the bottom end 244 is a draft 245, which is a mirror of a draft 243 on the right end 248. Similarly, lower funnel panel 260 includes the upper end 262, a bottom end 264, a left end 266, and a right end 268. Extending from about the middle of the left end 266 to the bottom end 264 is a draft 265, which is a mirror of a draft 263 on the right end 268. Lower funnel panels 240 and 260 are generally rectangular in shape, excepting that the drafts 243, 245 and 263,265 effectively remove corners of the rectangular shape on the bottom ends 244,264.

Lower funnel panel 250 includes the upper end 252, a bottom end 254, a left end 256, and a right end 258. Each of the left end 256 and right end 258 of lower funnel panel 250 includes a cut-in portion 255,253, respectively, corresponding to the right end 248 of the lower funnel panel 240 and the left end 266 of the lower funnel panel 260. The left end 256 includes a draft portion 251 and the right end 258 includes a draft portion 241 which angle from the end of each cut-in portion 255,253 to the bottom end 254 of the lower funnel panel 250.

Lower funnel panel 270 includes the upper end 272, a bottom end 274, a left end 276, and a right end 278. Each of the left end 276 and right end 278 includes a cut-in portion 275,273 corresponding to the right end 268 of the lower funnel panel 260 and the left end 246 of the lower funnel panel 240. The left end 276 includes a draft portion 271 which angles from the end of the cut-in portion 275 to the bottom end 274 of the lower funnel panel 270. The right end 278 includes a straight portion 261 which extends from the end of the cut-in portion 273 to the bottom end 274 of the lower funnel panel 270.

Lower funnel panels 250 and 270 are generally trapezoidal in shape in the current embodiment.

None of the lower funnel panels 240,250,260,270 need be any specific shape, so long as they function as described in this disclosure.

Extending toward the inside of the funnel blank of FIG. 2 and connected to each lower funnel panel 240,250,260,270 is a connecting fin 290*a,b,c,d*. Each connecting fin 290*a,b,c,d* includes a tab portion 292*a,b,c,d*. Connected to each tab portion 292*a,b,c,d* are two ear portions 294*a,b,c,d* and 296*a,b,c,d* extending laterally in opposing directions. In the current embodiment, the ear portions 294*a,b,c,d* and 296*a,b,c,d* are semi-circular and are connected to the tab portions 292*a,b,c,d* by bend lines 297*a,b,c,d* and 298*a,b,c,d*, respectively. The bend lines 297*a,b,c,d* and 298*a,b,c,d* are creases in the current embodiment, although other connections are included within this disclosure. Although features of the funnel blank of FIG. 2 are referenced as "inner", "outer", "left", and "right" in the current embodiment, configurations may be changed or reversed in alternative embodiments.

Figure 3:
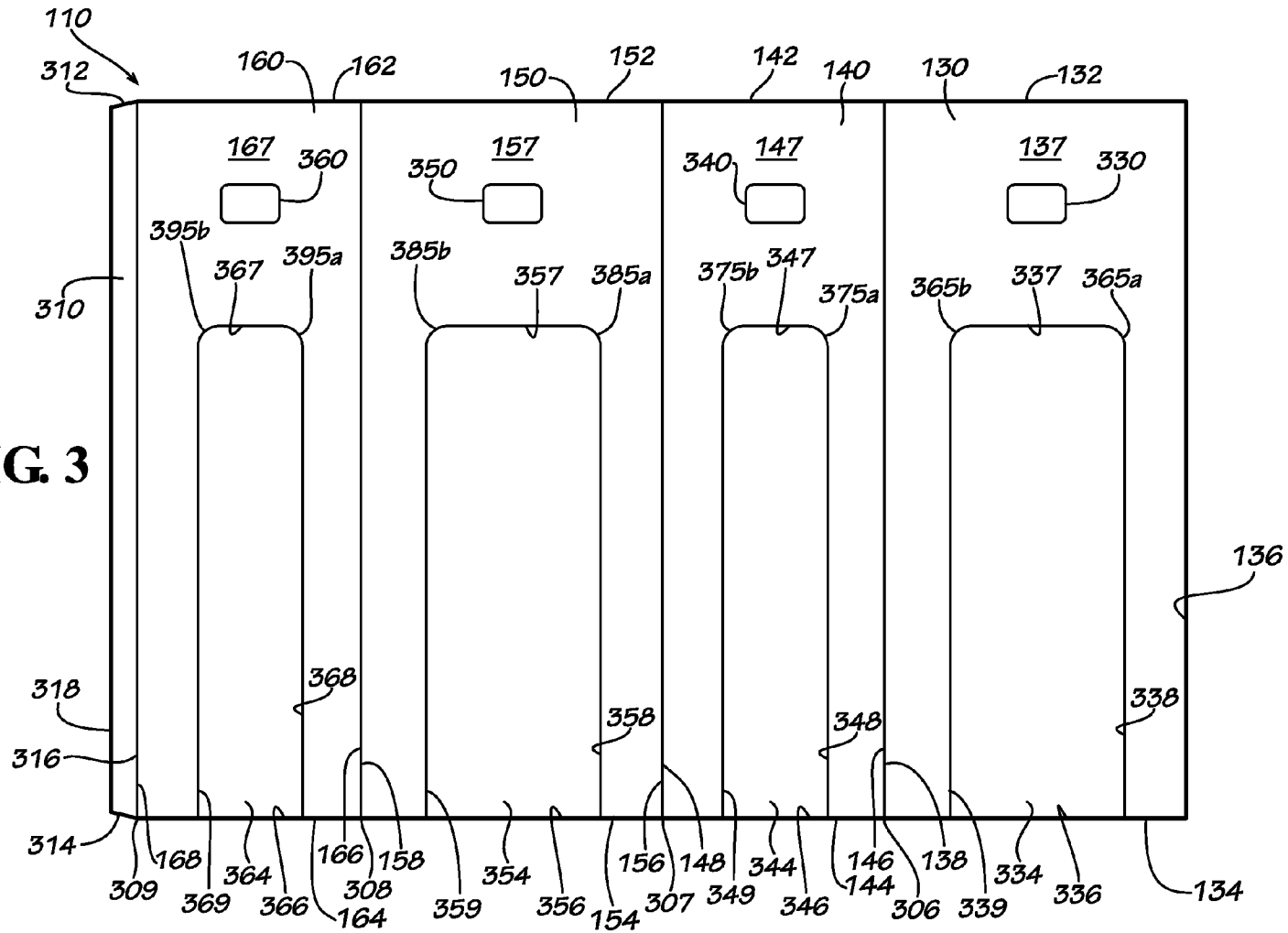
FIG. 3 is a schematic view of the inner surface of the hollow stand of the bag stand of FIG. 1.

FIG. 3 shows an inside view of an unassembled hollow stand 110. The hollow stand 110 is formable from a single cardboard stand blank folded onto itself, although other material choices and assembly methods are intended to be covered by the description in this disclosure. FIG. 3 shows an inside surface view of the stand blank, including inner surfaces 137,147,157,167. Attached to the right end 168 of side panel 160 is an attachment panel 310. The attachment panel 310 has a top end 312, a bottom end 314, a left end 316, and a right end 318. Both the top end 312 and the bottom end 314 are angled with respect to the bottom ends 134,144,154,164 and top ends 132,142,152,162 of the side panels 130,140,150,160 such that the length of the right end 318 as measured from top end 312 to bottom end 314 is shorter than the length of the left end 316 as measured from top end 312 to bottom end 314.

FIG. 3 displays an embodiment of the hollow stand 110 including connection cutouts 330,340,350,360. Each connection cutout 330,340,350,360 is a substantially rectangular cutout portion taken from each side panel 130,140,150,160 proximal to each top end 132,142,152,162, respectively. In the current embodiment, the rectangular cutouts have rounded or filleted corners. The connection cutouts 330,340, 350,360 extend through the side panels 130,140,150,160 from each outer surface 139,149,159,169 to each inner surface 137,147,157,167, respectively. The connection cutouts 330,340,350,360 need not be of any specific shape or have any specific features so long as they are capable of receiving the connecting fins 290*a,b,c,d* of the funnel 120. Examples of other acceptable shapes are ovular, circular, square, curvilinear, trapezoidal, and polygonal, among others. Connection cutouts 330,340,350,360 may not be utilized or needed in some embodiments.

Also included in the current embodiment of the hollow stand are relief punchout panels 334,344,354,364. The relief punchout panels 334,344,354,364 included in the current embodiment are substantially rectangular in shape, although they may be of any shape sufficient to perform the function for which they are included, and all applicable shapes are intended to be included in this disclosure. Each relief punchout panel 334,344,354,364 has a bottom end 336,346,356, 366, a top end 337,347,357,367, a left end 338,348,358,368, and a right end 339,349,359,369, respectively. Each bottom end 336,346,356,366 is colinear with the corresponding bottom end 134,144,154,164 of each corresponding side panel 130,140,150,160, respectively. Rounded or filleted corners 365*a*,375*a*,385*a*,395*a* are located at the intersection of each top end 337,347,357,367 with each left end 338,348,358,368, respectively. Rounded or filleted corners 365*b*,375*b*,385*b*, 395*b* are located at the intersection of each top end 337,347, 357,367 with each right end 339,349,359,369, respectively. Other corner profiles are considered within this disclosure, including squared corners, perforated, punched, and other profiles. Also shown are bend lines 306,307,308,309 between each of the side panels 130,140,150,160 and between side panel 160 and the attachment panel 310.

Neither the connection cutouts 330,340,350,360 nor the relief punchout panels 334,344,354,364 need be included in every embodiment. In some embodiments, no connection cutouts will be included. In some embodiments, no relief punchout panels will be included. In some embodiments, connection cutouts may be included in fewer than all of the side panels. In some embodiments, relief punchout panels may be included in fewer than all of the side panels. Moreover, if included in an embodiment, either or both of the connection cutouts and the relief punchout panels may be designed as punchout panels for a user to remove or may be supplied as cutout portions with material previously removed, among other configurations. Although features of the blank of FIG. 3 are referenced as "inner", "outer", "left", and "right" in the current embodiment, configurations may be changed or reversed in alternative embodiments.

Figure 6:
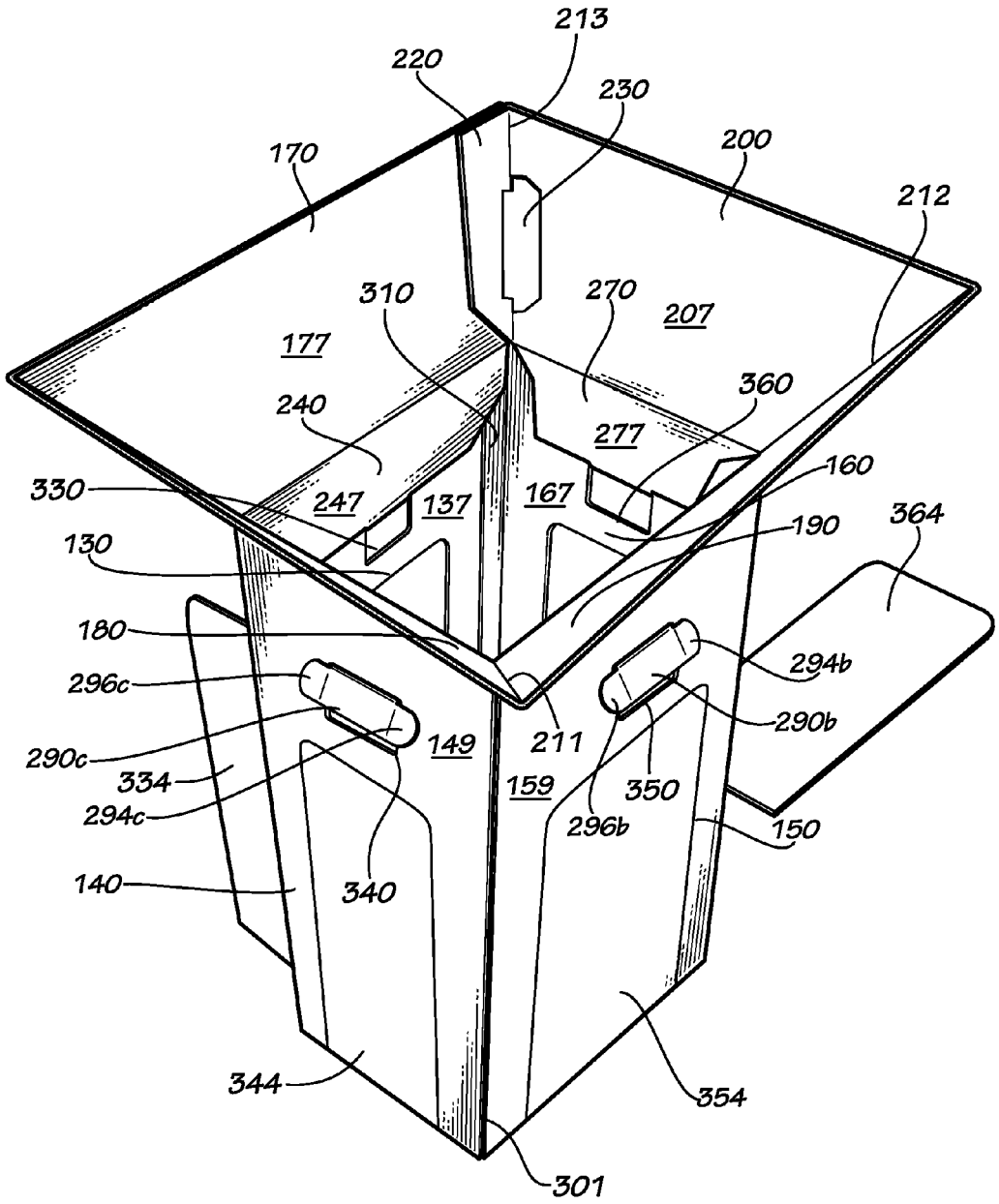
FIG. 6 is a perspective view of the assembled bag stand of FIG. 1 including the funnel of FIG. 2 in the final funnel shape.

FIG. 4 displays the funnel 120 in transition from the funnel blank of FIG. 2 to the final funnel shape of FIG. 6. As seen, each of the upper funnel panels 170,180,190,200 is shown to be bent along the bend lines 210,211,212. The connection tab 220 has also been bent along bend line 213. When the connection tab 220 is bent inwardly, it presents the slot 225 to the insertable tab 230. The insertable tab 230 is shown bent along bend line 214 and ready for insertion into the slot 225. The insertable tab 230 is sized so that its ear portions 236*a,b* extend slightly beyond the slot 225 so that insertion of the insertable tab 230 into the slot 225 will create a connected interface between upper funnel panel 170 and upper funnel panel 200. When the insertable tab 230 is inserted into the slot 225, the funnel 120 has reached its final funnel shape of FIG. 6, having all upper funnel panels 170,180,190,200 connected to each other.

In some embodiments, the funnel 120 need not be assembled by inserting the insertable tab 230 into the slot 225. Instead, in some embodiments, the funnel 120 may be provided with the insertable tab 230 pre-inserted into the slot 225. In alternative embodiments, the connection between upper funnel panels 170 and 200 will be integrated, obviating the need for an insertable tab 230 or slot 225 and thereby obviating the insertion step described above.

Figure 5:
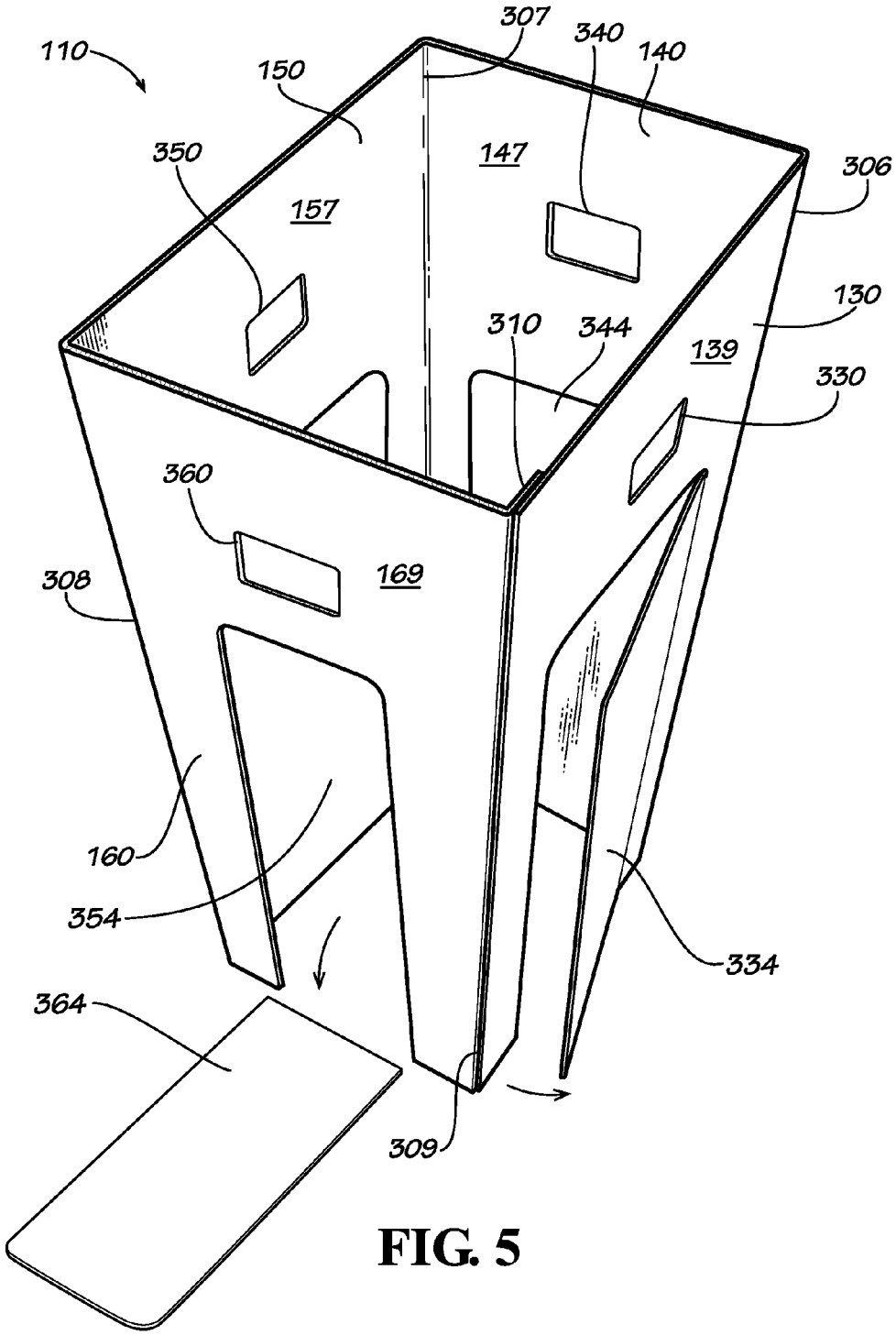
FIG. 5 is a perspective view of the hollow stand of the bag stand of FIG. 1.

FIG. 5 shows a perspective view of the assembled hollow stand 110. The side panels 130,140,150,160 have been folded along bend lines 306,307,308. The attachment panel 310 is shown bent along bend line 309. In the current embodiment, the attachment panel 310 is folded inside of the side panel 130 and connected by gluing. Alternative embodiments include the attachment panel 310 folding outside of the side panel 130, notched connections, and integrated connections, among others. The attachment panel 310 may also be integrated with the side panel 130 and attached to side panel 160, the reversed embodiment of that shown in FIG. 5. The resulting structure is a hollow stand 110 with a rectangular cross-section and open ends along the top and the bottom. The current embodiment includes relief punchout panels 334 and 364, where other relief punchout panels 344,354 were not included as part of the hollow stand 110. One relief punchout panel 334 has been peeled back in accord with one embodiment, where another relief punchout panel 364 has been removed completely in accord with another embodiment. Connection cutouts 330,340,350,360 are shown on each side panel 130,140,150,160, respectively. The current embodiment of the hollow stand 110 includes an open top and an open bottom, although a closed bottom hollow stand 110 may be included in some embodiments.

FIG. 6 shows a perspective view of the assembled bag stand 100 with the funnel 120 placed on top of the hollow stand 110. The upper funnel panels 170,180,190,200 of the funnel 120 extend above the hollow stand 110 flaring outwardly and defining a funnel shape with rectangular cross-section. The lower funnel panels 240,270 (250,260 not shown) extend inside the hollow stand 110 below the top ends 132,142,152,162 (shown in FIGS. 1 and 3) of the side panels 130,140,150,160. The connecting fins 290*b,c* (290*a,d* not shown) of the funnel 120 are inserted through the connection cutouts 330,340,350,360 of the side panels 130,140,150,160. The ear portions 294*a,b,c,d* and 296*a,b,c,d* are sized so that they extend beyond the sides of the connection cutouts 330,340,350,360. The configuration thereby secures the funnel 120 to the top of the hollow stand 110 because the connecting fins 290*a,b,c,d* cannot be pulled back through the connection cutouts 330,340,350,360 without effort.

FIG. 6 also shows that relief punchout panels 334 and 364 have been removed from side panels 130 and 160 as shown in FIG. 5. In the disclosed embodiment, relief punchout panel 334 and 364 are included, and other relief punchout panels 344,354 are not included in the embodiment. The relief punchout panels 334,344,354,364 allow refuse to pass more easily from the funnel 120 through the hollow stand 110. Refuse that would tend to clog in the hollow stand 110 may be freed by the opening created by removal of any of the relief punchout panels 334,344,354,364. Moreover, when at least one of the relief punchout panels 334,344,354,364 is removed, air may pass more easily from the inside of the hollow stand 110 to the outside, further allowing refuse to flow more easily from the funnel 120 through the hollow stand 110.

Figure 7:
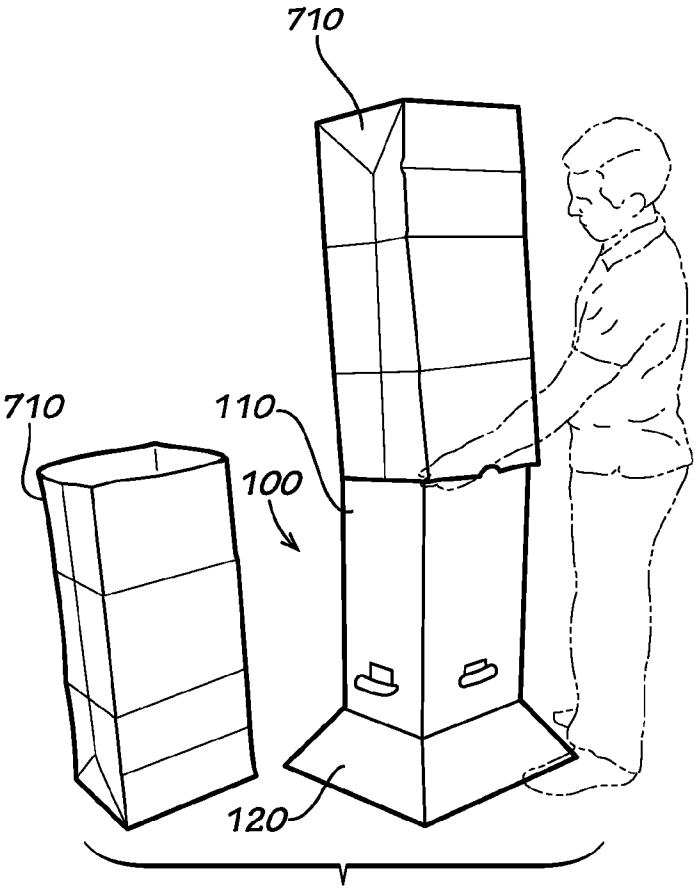
FIG. 7 is a perspective view of the assembled bag stand of FIG. 1 in an inverted position including a lawn refuse bag.

As shown in FIG. 7, a refuse bag 710 is placed over the hollow stand 110 of the bag stand 100. In the current embodiment, the refuse bag 710 is a standard sized paper lawn refuse bag, although other size or material refuse bags may be used in alternative embodiments. The bag stand 100 is dimensioned to fit inside the refuse bag 710, although other configurations are contemplated by and included within this disclosure. In alternative embodiments, the hollow stand 110 may be arranged outside of the bag or may be integrated with or attached to the bag.

Figure 8:
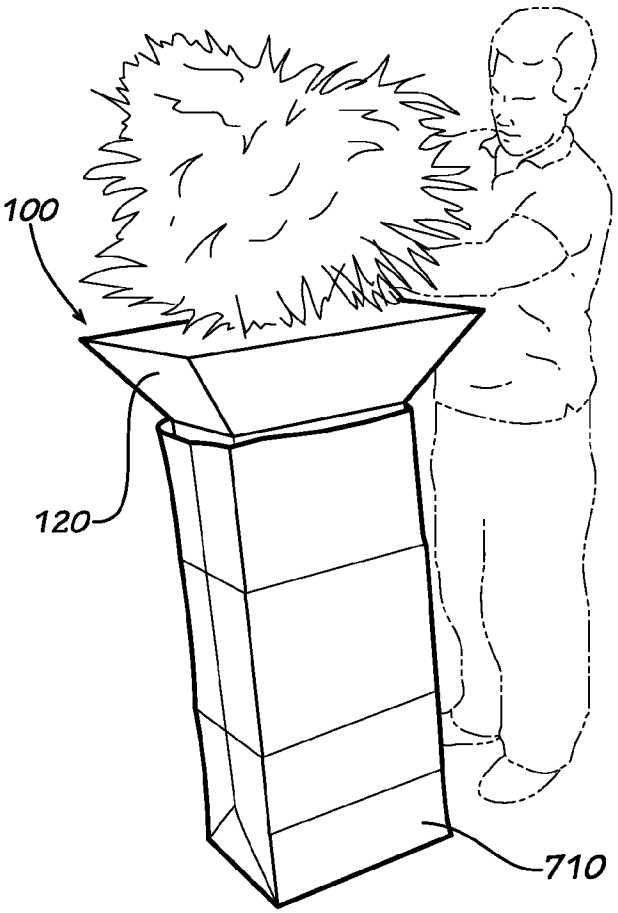
FIG. 8 is a perspective view of the assembled bag stand of FIG. 1 including a lawn refuse bag in use in accord with one embodiment.

FIG. 8 displays the bag stand in use. A user fills the bag stand 100 and, thereby, the refuse bag 710 with refuse by inserting the refuse into the funnel 120. The funnel 120 allows the user to place larger amounts refuse into the refuse bag 710 at one time than would be allowed by attempting to fill the refuse bag 710 without the bag stand 100. The hollow stand 110 holds the refuse bag 710 in the standing position, preventing it from collapsing under the weight of any refuse caught in the refuse bag 710. The hollow stand 110 serves to elevate the funnel 120 a distance above the ground higher than the top of the refuse bag 710, thereby preventing refuse from contacting the refuse bag 710 and causing collapse of the refuse bag 710. The hollow stand 110 also prevents refuse from puncturing the refuse bag 710 by providing a physical barrier between the refuse—which may include puncturing refuse such as tree branches or sharp stones—and the refuse bag 710.

When the refuse bag 710 is filled, the current embodiment allows removal of the bag stand 100 from the inside of the refuse bag 710 to permit reuse of the bag stand 100 with another refuse bag 710. In alternative embodiments, the bag stand 100 may be discarded along with the refuse and the refuse bag 710. Additionally, in alternative embodiments, the bag stand 100 may be positioned outside of the refuse bag 710 or another bag to be filled, and, thus, the bag stand 100 may not need to be removed from inside of the refuse bag 710 in alternative embodiments.

Figure 9:
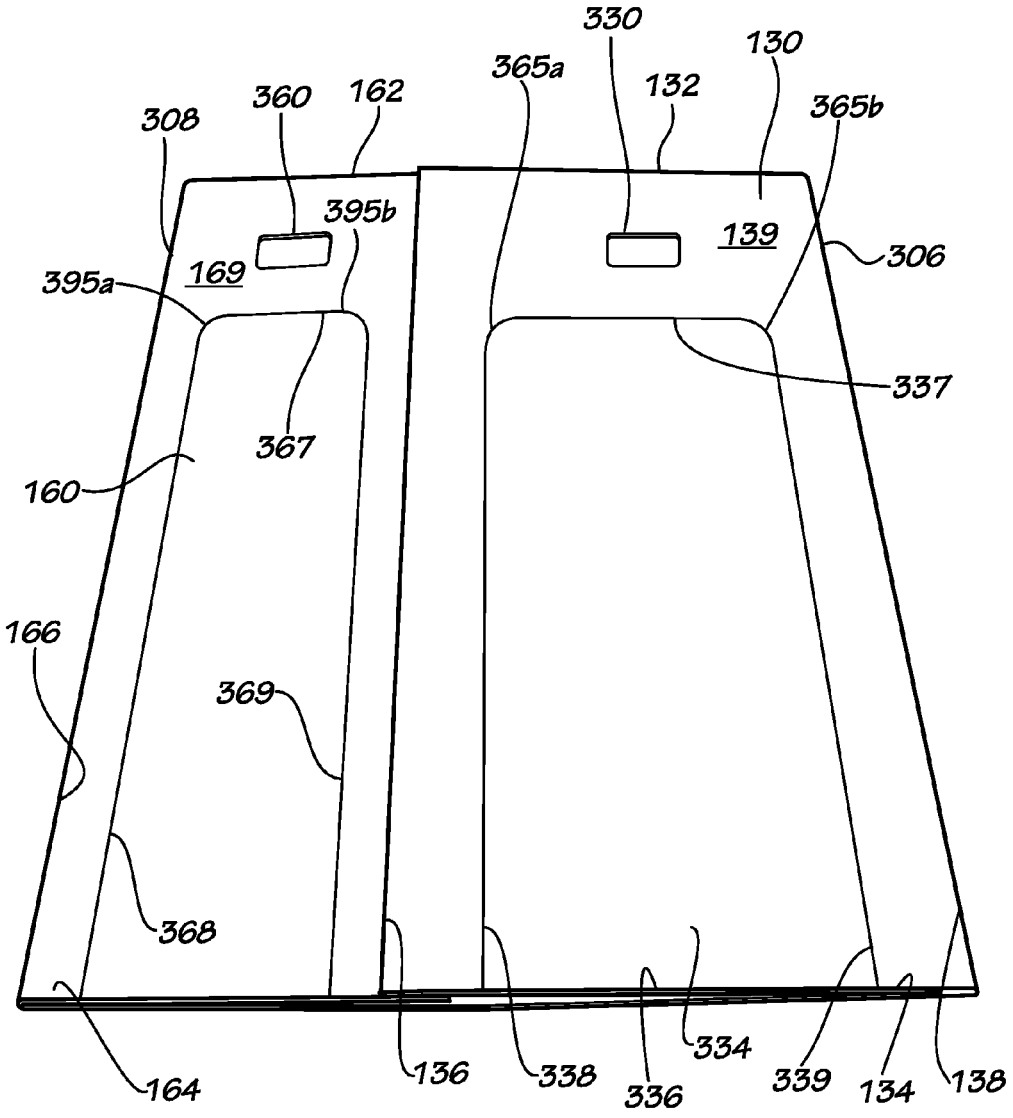
FIG. 9 is a side view of the hollow stand of FIG. 3 in a flattened arrangement.
Figure 10:
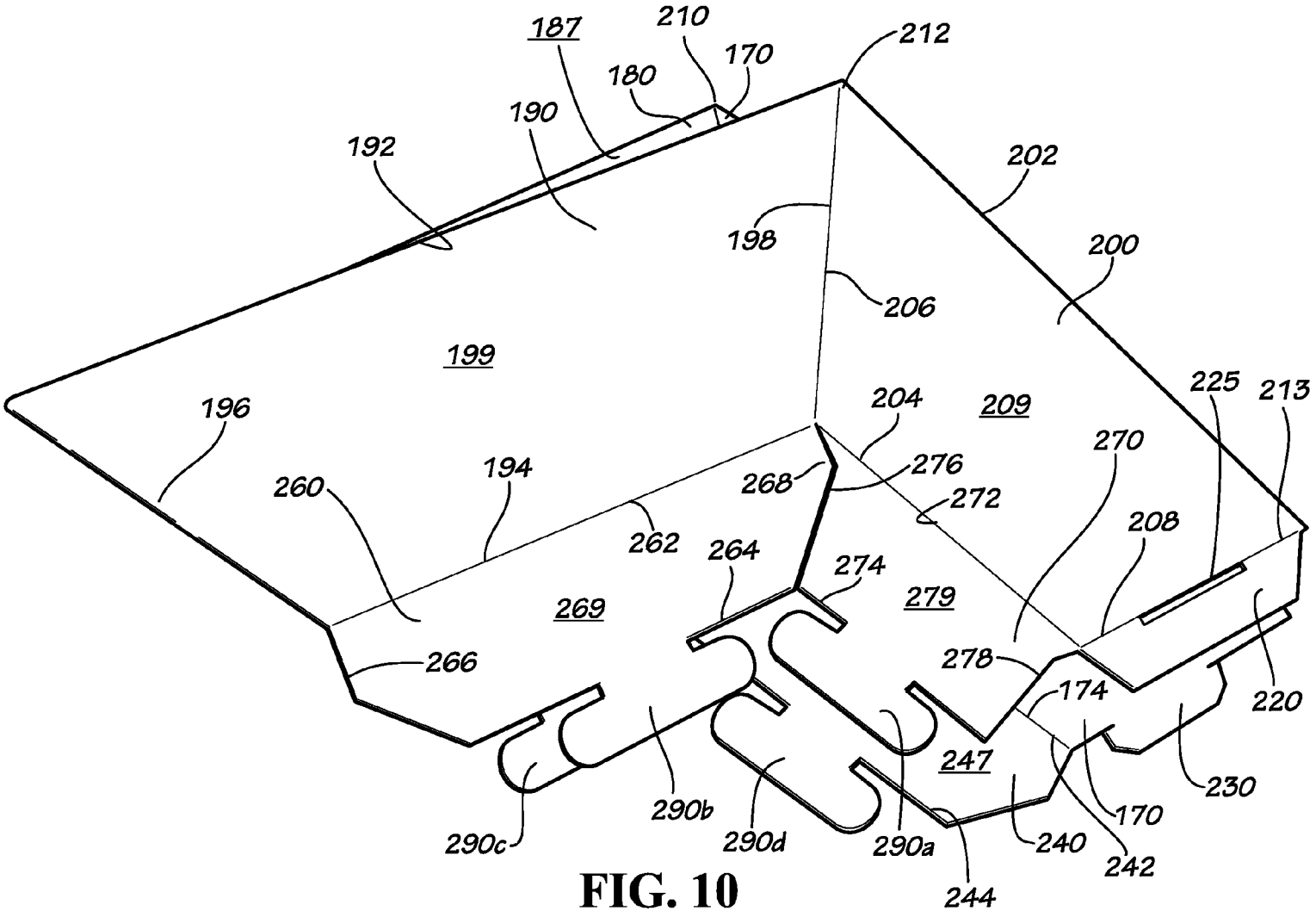
FIG. 10 is a side view of the funnel of FIG. 4 in a flattened arrangement.

In some embodiments, the funnel 120 and hollow stand 110 may be provided to the user in a preassembled but flattened arrangement, as seen in FIGS. 9 and 10.

As seen in FIG. 9, the hollow stand 110 may be supplied in a flattened arrangement. In this arrangement, the side panels 130,140,150,160 of the hollow stand 110 are all connected and the hollow stand 110 is flattened. Attachment panel 310 is not bent along bend line 309 but is glued to the inside surface 137 of side panel 130 as in previously described embodiments. As shown, the bend line 306 between panels 130 and 140 (not shown) is bent. Similarly, the bend line 308 between panels 150 (not shown) and 160 is bent. This configuration allows simple shipping, storage, and assembly for use, as the user need not attach any pieces manually. However, other configurations, including different attachments, assembly, shipping, or storage means are included in this disclosure.

As seen in FIG. 10, the funnel 120 may be supplied in a flattened arrangement. In this arrangement, bend line 211 is bent so that upper funnel panels 200 and 190 are shown on top of upper funnel panels 180 and 170 with bend lines 210 and 212 unbent so that inner surfaces 177 and 187 contact inner surfaces 197 and 207. This configuration allows simple shipping, storage, and assembly for use, as the user need not attach any pieces manually. However, other configurations, including different attachments, assembly, shipping, or storage means are included in this disclosure.

Figure 11C:
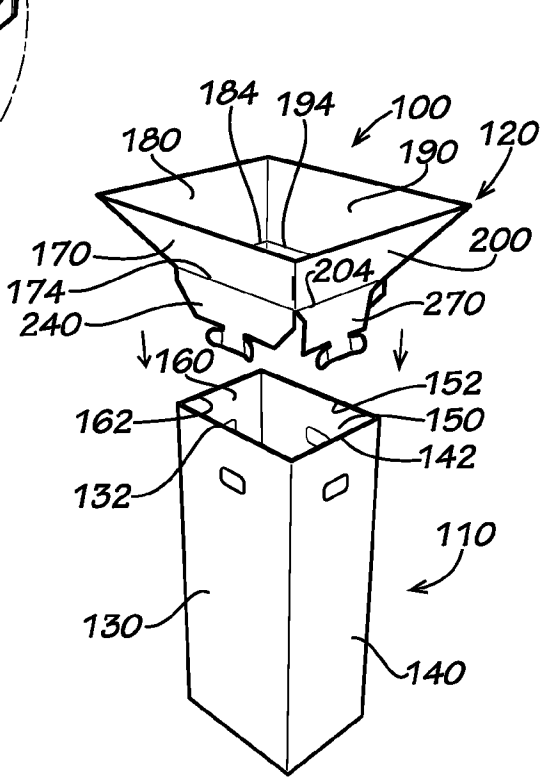
FIG. 11C is a perspective view of the assembly of the bag stand of FIG. 11A.
Figure 11B:
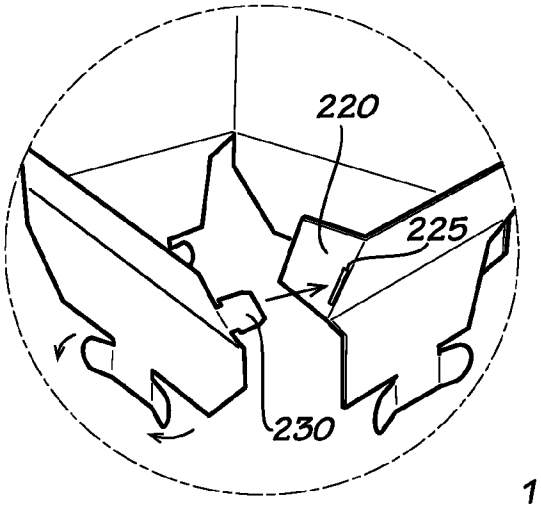
FIG. 11B is a detail view of the assembly of the funnel of the bag stand of FIG. 11A.
Figure 11A:
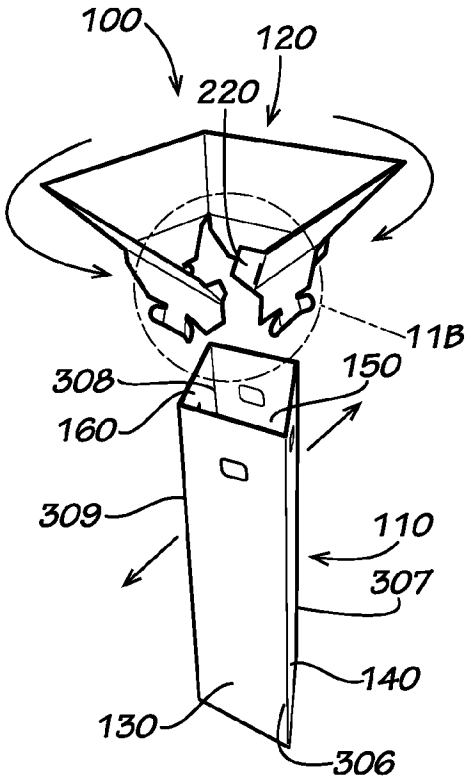
FIG. 11A is a perspective view of the assembly of the bag stand of FIG. 1.

A user of the bag stand 100, upon receiving the funnel 120 of FIG. 10 and the hollow stand 110 of FIG. 9, assembles the bag stand 100 as shown in FIGS. 11A, 11B, and 11C. The user first un-flattens the hollow stand 110 of FIG. 9, moving side panels 130,140,150,160 by bending at bend lines 306,307,308,309 until the hollow stand 110 is about rectangular in cross-section. The motion is shown in FIG. 11A. The user then un-flattens the funnel 120 of FIG. 10 until it is about rectangular in cross-section, first folding the connection tab 220 inside and then inserting the insertable tab 230 into the slot 225. The motion is shown in FIGS. 11A and 11B. The user then lines up the bottom ends 174,194 of the upper funnel panels 170,190 with the top ends 132,152 of the side panels 130,150 and also lines up the bottom end 184,204 of the upper funnel panels 180,200 with the top ends 162,142 of the side panels 160,140. The user then places the funnel 120 on the hollow stand 110 with the lower funnel panels 240,250,260, 270 extending inside the hollow stand 110. This motion is shown in FIG. 11C. The user then pushes each connecting fin 290*a,b,c,d* through each connection cutout 330,340,350,360 to hold the funnel 120 in place on top of the hollow stand 110, as shown in FIG. 6. The user may optionally remove any or all of the relief punchout panels 334,344,354,364 as seen in FIGS. 5 and 6. Once the bag stand 100 is assembled, the user may place a lawn refuse bag 710 over the hollow stand 110 as seen in FIG. 7 and then turn the bag stand 100 over and fill the bag stand 100 with refuse as seen in FIG. 8. Once a sufficient amount of refuse has been placed inside the bag stand 100, the user may optionally remove the bag stand 100 from the lawn refuse bag 710 and discard the lawn refuse bag 710. In alternative embodiments, the bag stand 100 is disposable along with the lawn refuse bag 710, obviating the previously described removal step.

This assembly configuration represents one of many possible assembly configurations. One skilled in the art will understand obvious variations of this assembly configuration are included within this disclosure, including variations of steps, combinations of steps, and dissections of steps, among others. Moreover, assumptions about the preassembly configuration of the hollow stand 110 and funnel 120 should not be imported into the assembly configuration. For example, although the user in the current embodiment need insert the insertable tab 230 into the slot 225, in alternative embodiments, the user may need only un-flatten the funnel 120 from a flattened but assembled state as part of the assembly of the bag stand 100. In some embodiments, the lower funnel panels 240,250,260,270 need not be included with the funnel 120. Other portions of the lower funnel panels 240,250,260,270 including the connecting fins 290*a,b,c,d* also need not be included in every embodiment. Where materials are chosen for the elements of this assembly—particularly, corrugated cardboard—similar generally rigid material choices may also be used and would be obvious to one in the art, including corrugated cardboard or paper, linerboard, polymer, plastic, metal, alloy, wood, mesh, laminate, reinforced woven or non-woven fabric, cellulose, composite, and combinations or mixtures of the foregoing, among others.

The invention claimed is:

1. A bag stand comprising:

a hollow stand having an inner surface, an outer surface, a top end, and a bottom end, the hollow stand including four side panels, a relief punchout panel defined in a first side panel of the four side panels of the hollow stand, a bottom end of the relief punchout panel being defined along the corresponding bottom end of the first side panel, each side panel having two ends, each end of each side panel connected to an adjacent end of another side panel to form a substantially continuous hollow stand outer surface and a substantially continuous hollow stand inner surface, the substantially continuous hollow stand inner surface defining an opening along the top end of the hollow stand, the four side panels forming a rectangular cross-section of the hollow stand; and a funnel having an inner surface, an outer surface, a top end, a bottom end, and at least two side ends, the funnel defining at least one slot along one side end, at least one side end including an insertable tab, the funnel defining an opening at each of the top end and the bottom end of the funnel, the top end of the funnel having a larger opening and the bottom end of the funnel having a smaller opening, wherein the funnel and hollow stand may be configured so that the smaller opening of the funnel interfaces with the top end of the hollow stand.

2. The bag stand of claim 1, wherein the hollow stand defines at least one connection cutout on at least one side panel.

3. The bag stand of claim 2, wherein the funnel further includes at least one connecting fin.

4. The bag stand of claim 1, wherein each side panel defines at least one punchout panel.

5. A blank formable into a hollow stand, the blank comprising:

at least two side panels, each said at least two side panels including an inner surface;

an outer surface;

a top end;

a bottom end;

a right end;

a left end; and a relief punchout panel, wherein the right end of each said at least two side panels is connectable to the left end of another side panel of the at least two side panels by an attachment panel to form a hollow stand including a top end, a bottom end, an inner surface, and an outer surface, wherein a bottom end of the relief punchout panel is defined along the corresponding bottom end of each at least two side panels, and where the hollow stand defines an opening along the top end of the hollow stand.

6. The blank of claim 5, wherein at least one side panel defines at least one connection cutout.

7. The blank of claim 5, the blank including a bend line between each side panel and each adjacent side panel.

8. The blank of claim 5, wherein the blank is made from corrugated cardboard.

9. A method of assembling a bag stand comprising the steps of:

receiving a hollow stand having at least one side panel, each at least one side panel having a top end, a bottom end, a left end, a right end, and a connection cutout proximal to the top end, the right end of each at least one side panel connected to the left end of at least one adjacent side panel, a relief punchout panel defined in a first side panel of the at least one side panel, wherein a bottom end of the relief punchout panel is defined along the corresponding bottom end of the first side panel, the hollow stand in a flattened arrangement;

removing at least one relief punchout panel;

receiving a funnel having at least one upper funnel panel, at least one lower funnel panel, and at least one connecting fin, each at least one upper funnel panel connected to a lower funnel panel, each at least one upper funnel panel having a top end, a bottom end, a left end, and a right end, the funnel in a flattened arrangement;

unflattening the hollow stand to a shape sufficient to hold open a refuse bag, the shape defining a cross-sectional shape of the hollow stand;

unflattening the funnel;

inserting an insertable tab of the funnel into a slot of the funnel to form a funnel shape;

bending the funnel so that a cross-sectional shape of the funnel corresponds with the cross-sectional shape of the hollow stand;

placing the funnel onto the hollow stand so that the bottom ends of the at least one upper funnel panel correspond with the top end of the at least one side panel; and inserting each at least one connecting fin into the connection cutout of a one of the at least one side panel, thereby forming a bag stand.

* * * * *